United States Patent [19]

Wilkinson

[11] 4,013,129

[45] Mar. 22, 1977

[54] RIPPER FOR ATTACHMENT TO TRACTOR

[75] Inventor: John R. Wilkinson, Arlington Heights, Ill.

[73] Assignee: International Harvester Company, Chicago, Ill.

[22] Filed: Sept. 24, 1975

[21] Appl. No.: 616,457

[52] U.S. Cl. ..... 172/464; 172/250; 172/484; 172/699

[51] Int. Cl.[2] ..... A01B 13/08; A01B 63/102

[58] Field of Search ..... 172/307, 315, 316, 326, 172/444, 448, 464, 484, 668, 699, 700, 250; 37/193; 61/72.6

[56] References Cited

UNITED STATES PATENTS

| | | | |
|---|---|---|---|
| 3,060,696 | 10/1962 | Lang | 61/72.6 |
| 3,503,456 | 3/1970 | Larson | 172/484 |
| 3,527,308 | 9/1970 | Bernotas et al. | 172/464 |

*Primary Examiner*—Richard T. Stouffer

*Attorney, Agent, or Firm*—John W. Gaines; Floyd B. Harman

[57] ABSTRACT

Attachment for a tractor to do ripping, having parallelogram linkages which support a ripper shank assembly for movement between a raised-carry position and a lowered-rip position. The linkages each have an extensible side consisting of an hydraulic cylinder which allows the shank assembly to be pitched about a transverse horizontal beam axis when located in either of the just mentioned positions or any positions therebetween. A further hydraulic cylinder is connected on one end thereof to a mounting tower by a removable pin for attachment to the tractor and on the other end thereof to a clevis pivot in coaxial alignment with the horizontal beam pitch axis. This further hydraulic cylinder functions as a depth actuator.

5 Claims, 4 Drawing Figures

18
40
38
20
40
54
14
22
16
22
38
22
42
44
50
26
18
36
54
24
46
32
58
30
30
28
48
12
10
12

26
40
38
38
22
54
10
14
18
32
44
12
42
48
52
46
56
20b
30
28
24
34
24
20
20a

RIPPER FOR ATTACHMENT TO TRACTOR

This application relates to a multi cylinder mounting for tractors to support rippers at the rear thereof, effective hydraulically for depth adjustment and for pitch adjustment.

Prior ripper mounting linkages providing for hydraulic depth adjustment and hydraulic pitch adjustment usually include a so-called draft frame, somewhat complicated in the respect that the connections for the depth adjustment are made to such draft frames rather than directly to the ripper shank assembly. In some cases, the depth actuators connected to the draft frame for the mentioned purpose have been in an outboard location exposed to the earth material being discharged rearwardly from the traction means, such as crawler tracks, on the vehicle doing the ripping. Or the hydraulic actuators for the pitch adjustment have been located alone or with the depth acuators in an outboard location exposed to the material. Such a location, for the sake of symmetry, perforce requires a plurality of the depth actuators if they are outboard and/or a plurality of the pitch actuators if they are outboard. One known effort to medially offset the depth actuators has resulted in an arrangement whereby adjustment of pitch changes the depth adjustment or adjustment in depth changes the pitch adjustment or both.

My invention with the utilization of a particular geometry including inboard depth cylinder means materially reduces or substantially eliminates the foregoing drawbacks, as will now be explained in detail. Features, objects, and advantages will either be specifically pointed out or become apparent when, for a better understanding of my invention, reference is made to the following description, taken in conjunction with the accompanying drawings which show certain preferred embodiments thereof and in which.

Figure 1:
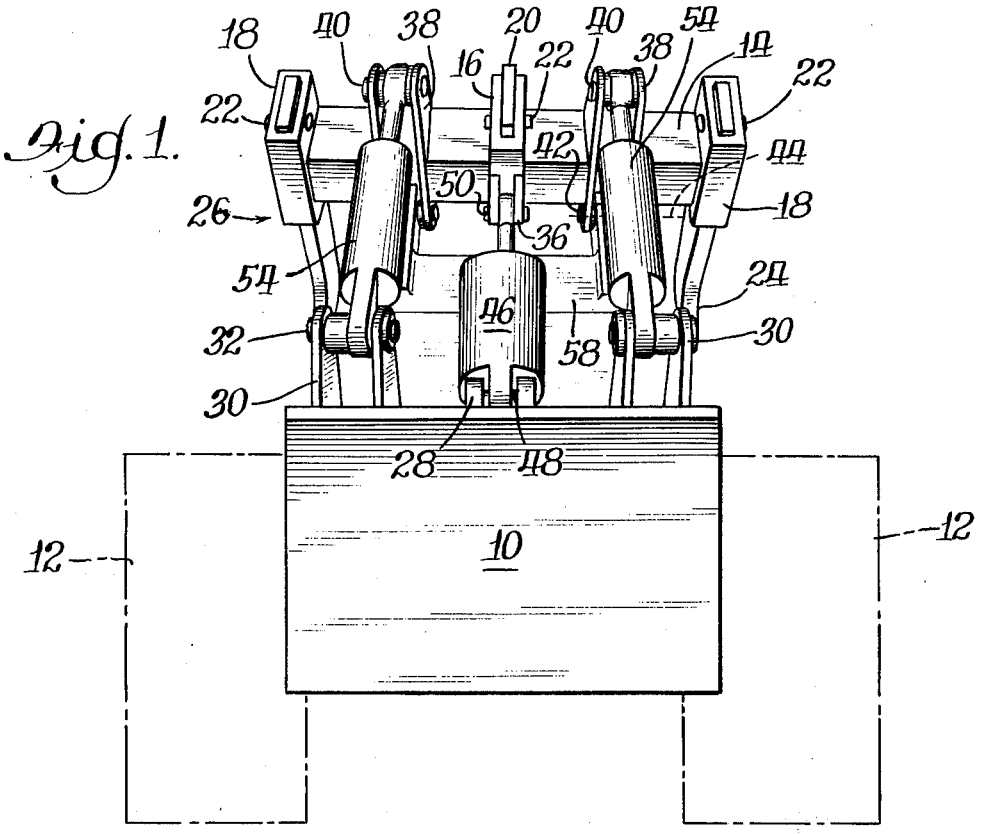
FIG. 1 is a front perspective view looking rearwardly from a tractor carrying the attachment according to my invention and looking over same.
Figure 2:
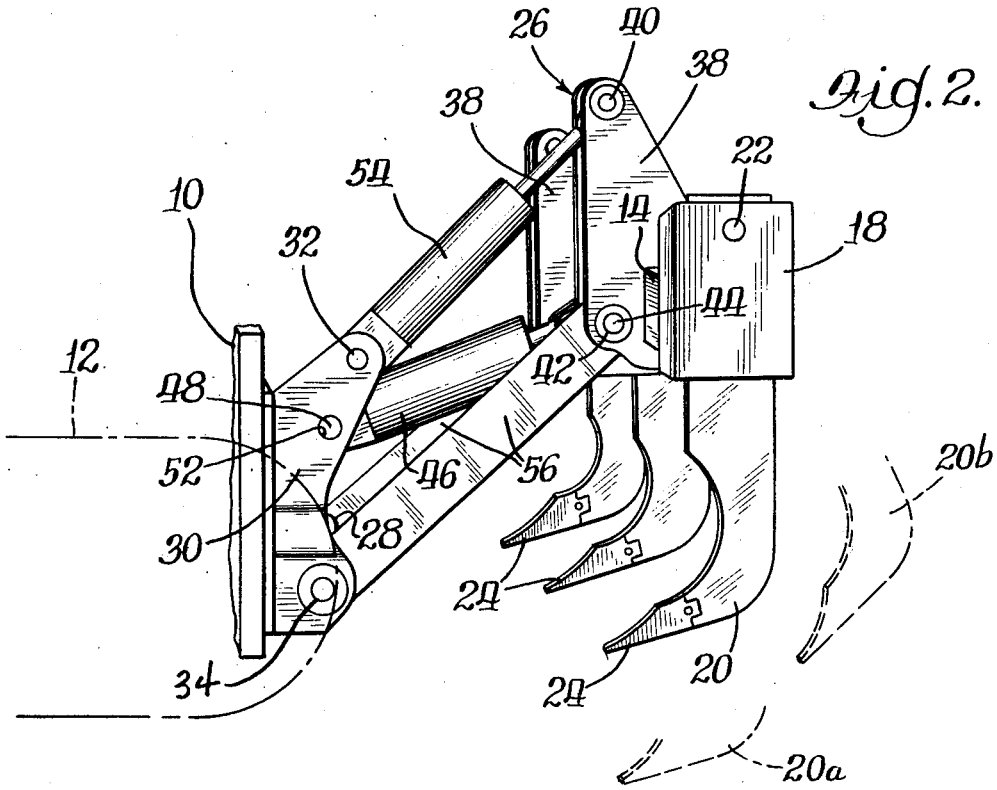
FIG. 2 is a side perspective of the attachment as it appears while viewing the left rear side of the tractor.

More particularly in FIGS. 1 and 2 of the drawings, a tractor 10 having conventional left and right crawler tracks 12 carries a transversely disposed horizontal tool beam 14 at the rear. The beam is of generally square cross section and includes a box-shaped central shank holder 16 (FIG. 1) and left and right end shank holders 18. The shanks of individual rippers 20 are secured by cross pins 22 in the individual holders, and are sharp tipped for penetration in the ground by reason of carrying replaceable ripper teeth 24 at the bottom of the ripper.

The foregoing beam 14 and shank holders 16 and 18 are integrated together to constitute a ripper shank assembly 26, and means is provided to support the shank assembly in positions on the rear of the tractor 10 including a raised-carry position for the rippers 20 as shown in solid lines in FIG. 2, an infinity of intermediate positions for the rippers such as the position therefor as shown by the broken lines 20*a* in FIG. 2, and an extreme lowered-rip position for the rippers, not shown.

Illustrative of one such positioning-support means is a draft frame linkage including a central mounting clevis 28 and two vertical mounting towers 30 attached by bolts to a vertical support plate on the rear of the tractor 10. The arrangement is such that the clevis 28 with the two towers 30 outboard thereof occupies a common vertical reference plane therewith, transverse to the tractor 10 and its line of ripping movement.

The towers 30 have upper pivots 32 outwardly and upwardly offset in the reference plane from the mounting clevis 28. The towers 30 also have lower pivots 34 (FIG. 2) spaced apart in the reference plane from the mounting clevis 28 and rendering the latter medially offset and also offset upwardly at a height at least a major part and preferably about three-fourths of the vertical distance from the height of the tower lower pivots 34 to the height of the tower upper pivots 32.

The ripper shank assembly 26 at its front further includes, at the center, an inner front clevis 36 (FIG. 1) integral with the central holder 16 of the tool beam 14, and two vertically disposed brackets 38 affixed rigidly to the beam 14 at points intermediate the inner clevis 36 and the shank holder 18 forming each end of the beam 14. Each beam bracket 38 has an upper pivot 40 outwardly and upwardly offset from the beam shank holder clevis 36, and a lower front pivot 42 outwardly offset from, and together with, the beam shank holder clevis 36 mutually defining a beam pitch coaxis 44.

Linkage now to be described interconnecting the tractor 10 and shank assembly 26 consists, briefly, of remotely operated power cylinders and draft frame links forming varying length and fixed length members pinned together as an adjustable quadrilateral.

More specifically between and interconnecting the central mounting clevis 28 and beam inner clevis 36, which are in spaced fore and aft alignment with one another ahead of the beam 14, a single hydraulic depth actuator 46 is provided similarly in alignment therewith and having a front pin 48 connecting the actuator at its head end to the mounting clevis 28 and a rear pin 50 connecting the actuator at its rod end to the central inner clevis 36 which is front mounted on and integral with the tool beam 14 as described. The front pin 48 is in the transverse vertical reference plane previously mentioned, and the tower 30 at each outer side of the attachment is formed with an access hole 52 aligned in the reference plane with the pin 48. The pin 48 has the smaller diameter, for installation and removal of same through either access hole.

The single depth actuator 46 is in the vertical plane containing the longitudinal central axis of the tractor 10.

Between and interconnecting the tower upper pivot 32 at each side of the tractor and beam bracket upper pivot 40, which are in spaced, fore and aft alignment with one another (FIG. 1), an hydraulic pitch actuator 54 is provided having its head end at the front supported by the pivot 32 thereat and having its rod end at the rear supported by the pivot 40 thereat.

Between and interconnecting the tower lower pivot 34 at each side of the tractor and beam bracket lower pivot 42, which are in spaced, fore and aft alignment with one another (FIG. 2), a draft link 56 is provided having a draft plate 58 (FIG. 1) integral therewith and with the companion draft link 56 on the other side of the tractor.

A resulting pair of quadrilateral linkages at the sides of the tractor includes therein the pair of pitch actuators 54 as the respective upper links, the pair of beam brackets 38 as rear links, the fixed-predetermined-length pair of draft links 56 as lower links, and the pair of towers 30 as the fixed front links. Slight extensible movement of the pitch actuators 54, in their usual way of being in unison, from the position as shown in FIG. 2 will result in the quadrilateral linkages becoming true parallelograms in fore and aft extending, parallel vertical planes; thereupon, in the mode sometimes desired, the rippers 20 will maintain the same ripping angle to the earth at all depths to which they are set by the depth actuator 46.

With constant angle ripping, a difficulty sometimes encountered during a raising operation is that the points of the teeth 24 move toward the tractor 10 and wedge intervening slabs and boulders between themselves and the tractor. So for remotely releasing such wedged-in slabs and boulders, and also more generally for varying the angle of the points for optimum ripping angle according to material ripped, the remotely extensibly and foreshortenably operated depth actuator 46 is appropriately re-set hydraulically to establish a different rip angle for the ripper teeth.

Ripping as a term is used in the sense that underground obstacles are ripped out and surface paving is ripped up, and a furrow is ripped in the ground and along the earth's surface. To do so, the present ripper is pulled by the tractor 10 to penetrate and to upset and move obstacles and earth formation and man-made formation, that is, to go beneath the surface upon which the tractor is operating and to break through the formations to a certain depth as the tractor moves forward. Considerable traction is employed and considerable power is applied.

The single actuator 46 and pair of actuators 54 have, in addition to their capacity for powered foreshortenable and extensible motion, an equally important capacity for immobility at set-length corresponding to fixed ripping depths and a fixed ripping angle at each such depth.

MODIFICATION OF FIG. 3

In lieu of the previously descibed single, rather large-diameter depth actuator, this modification has dual inboard power cylinders in closely spaced adjacency to one another and forming a pair of relatively smaller hydraulic depth actuators 146. Each actuator 146 has a front pin 148 connecting the actuator at its head end to a mounting clevis 128 and a rear pin 150 connecting the actuator at its rod end to one of two coaxial actuator clevises 136 which are side-by-side on the central shank holder 116 of a tool beam 114.

The remaining rear attachment parts of a tractor 110 form the side quadrilateral linkages and include a:

| | |
|---|---|
| Ripper shank assembly 126 | Pitch actuators 154 |
| Tower pair 130 | Draft links 156 |
| Tower upper pivots 132 | Draft plate 158 |
| Tower lower pivots 134 | End shank holders 118 |
| Beam brackets 138 | Bracket lower pivot 142 |
| Bracket upper pivot 140 | Beam pitch axis 144 |

A pair of unitary pin retainers 160 is provided each having an eye 162 welded to the bracket upper pivot 140 concerned and having an attachment bar 164 secured by screws, not shown, to the adjacent one of the beam brackets 138.

MODIFICATION OF FIG. 4

Figure 3:
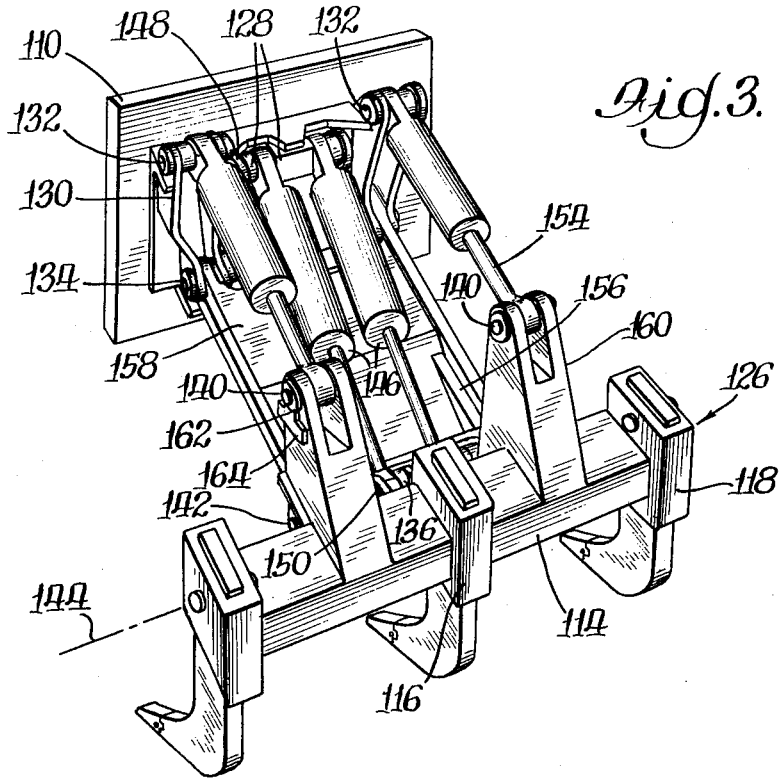
FIG. 3 is a rear perspective view somewhat similar to FIG. 1, but showing a dual depth actuator embodiment instead of a single depth actuator embodiment as previously shown.

In the ripper shank assembly 226 of the modification of the invention as shown in this Figure, a clevis-supported rear cylinder pin 250 and one of a pair of depth actuators 246 are located in spaced relation from the ripper attachment center line 251 so as to be about halfway between the center line 251 and an adjacent draft link 256. A similarly connected depth actuator and rear cylinder pin, not shown, are provided as mirror images on the other side of the center line 251, in an overall symmetrical arrangement affording to the two depth actuators 246 a wider spaced mutual separation than present between the closely adjacent dual actuators of FIG. 3 preceding; at the same time, the two actuators 246 are spaced well inside the fore and aft parallel vertical planes of the draft links 256 and their respective quadrilateral linkages concerned.

A bracket lower pivot pin 242 pivotally interconnects the rear end of the draft links 256 and the associated beam bracket 238.

At each side of the center line 251, the lower bracket pivot pin 242 tightly fits in a pivot-pin opening 266 of predetermined hole-size through the draft link 256 and beam bracket 238. Each of the cylinder pins 250 is about two-thirds as small in diameter and, because the parts are coaxially arranged on the beam pitch axis 244, the relatively smaller cylinder pins 250 are readily laterally installed and removed through the pivot pin openings 266. A pin retainer is shown at 262.

Figure 4:
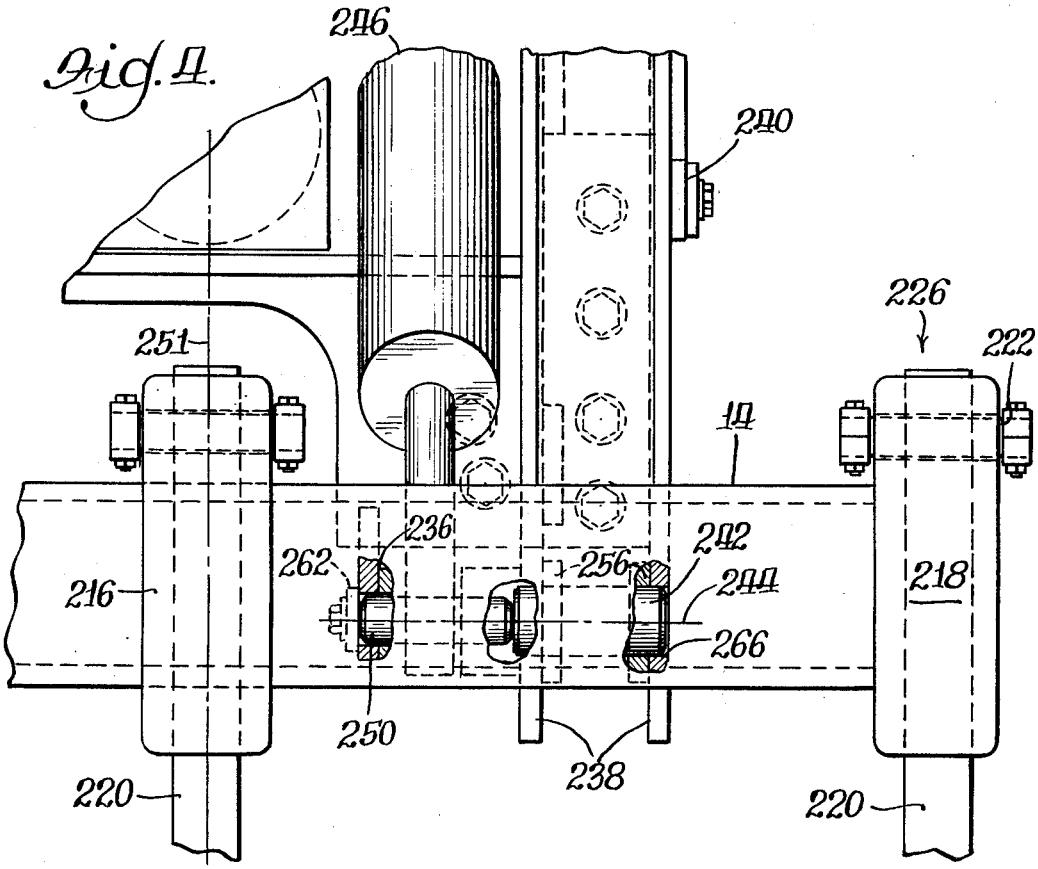
FIG. 4 is a rear elevational view showing a modified dual actuator embodiment of my invention.

The remaining shank assembly parts appearing in FIG. 4 include a:

| | |
|---|---|
| Tool beam 214 | Bracket upper pivot 240 |
| Central shank holder 216 | Cross pin 222 |
| End shank holder 218 | Inner clevis 236 |
| Rippers 220 | |

The actuators described are remotely actuated by the driver from the seat of the tractor, by means of hand valves, not shown, and a conventional hydraulic system with separate connections for pitch and depth control. The pitch actuators have coordinated operation characterized by foreshortenable movement to the same shortness in unison, extensible movement to the same length in unison, and immobility hydraulically locked at the same length, and the depth actuators have a similar coordinated operation with one another.

The pivots 50, 150, and 250 connecting all depth actuators disclosed herein directly to the tool beam, and in inboard locations, and at a point which always coincides with the beam pitch axis afford features of practical importance which are encountered in my way of making connections and which prove significant. In comparison to the common way of indirect connection, using cylinders secured to the draft frame, my way eliminates depth cylinder loading of the draft frame which superimposes bending forces thereon, simplifies the draft frame because tension forces are the sole stresses to be encountered, and introduces depth load directly, and free of torsion, into the tool beam which is heavy and can readily carry depth load with no need for reinforcement or other structural help. In comparison to the common way of indirect connection, using outboard cylinders secured to, and disposed in the vertical plane of, the draft links, my way appreciably reduces exposure to contamination from track discharge.

The remotely-operated depth actuators disclosed herein afford convenience to the driver who can change depth of rip while the tractor is operating. And when the depth actuator sets the ripper in the previously referred to position of raised-carry or slightly below, the pitch actuators are a decided convenience because the driver can hydraulically foreshorten the actuators 54 as viewed in FIG. 2, rotate the beam brackets 38 counterclockwise as there viewed about the beam pitch axis 44, and thereby provide an increase in angular penetration of the tooth of the ripper as shown in a broken line position by the broken lines 20*b*.

Or, when the depth actuator sets the ripper in an operating position above or actually in the previously referred to lowered-rip position and the ripper point snags and hangs up on a boulder, the driver again finds it convenient, as a matter of easy extrication, to foreshorten the actuators 54 again, rotate the beam brackets 38 in the same counterclockwise direction about the beam pitch axis 44, and thereby move the snagged ripper tooth rearwardly to facilitate removal of all ripper teeth from the ground. Although the ripper here shown is a three-shank ripper throughout, it is evident my invention equally applies to N-shank rippers, including single shank and five shank rippers.

Variations within the spirit and scope of the invention described are equally comprehended by the foregoing specification.

What is claimed is:

1. Means for supporting shanked ripper means from a tractor, so as to rip with remotely-adjustable pitch and depth actuation, said means comprising:

mounting clevis means and towers for attachment to the rear of the tractor;

a shank holding, horizontal tool beam spaced rearwardly from said mounting clevis means and tower and having at least a central shank holder, and provided at the front thereof with inner clevis means integral with the central shank holder of the tool beam, which clevis means includes a pivot spaced just forwardly of said tool beam, said tool beam also being provided with vertically disposed, outer beam brackets, said brackets each having an upper pivot outwardly and upwardly offset from said beam-shank-holder clevis means and a lower pivot outwardly offset from, and together with, said pivot of said beam-shank-holder clevis means mutually defining a coaxis, said coaxis being spaced just forwardly of said tool beam;

said mounting clevis means being in spaced alignment with the beam-shank-holder clevis means forwardly of the tool beam;

means for operatively directly connecting the tool beam to the rear of the tractor comprising hydraulic depth actuator means in direct alignment with the tool beam in the space in which said mounting and beam-shank-holder clevis means are in alignment and connected in said space at one end thereof to said beam-shank-holder clevis means at said coaxis and at the other end thereof to said mounting clevis means and effective for both foreshortenable and extensible motion, and immobility at fixed lengths corresponding to fixed ripping depths; said coaxis defining the pitch axis of the tool beam whereat the connected-on depth actuator means with its aforesaid motion introduces depth load in direct line into the tool beam;

said mounting towers having upper pivots outwardly and upwardly offset from said mounting clevis means and in spaced alignment with the beam bracket upper pivots, and having lower pivots in spaced alignment with the beam bracket lower pivots, and spaced apart in directions from said mounting clevis means rendering said mounting clevis means medially offset and also offset upwardly from said tower lower pivots at a height at least a major part of the vertical distance from the height of the tower lower pivots to the height of the tower upper pivots;

a pair of hydraulic pitch actuators between the upper pivots of the respective mounting towers and beam brackets effectively connected for foreshortenable and extensible movement conjointly, and immobility at fixed lengths corresponding to fixed ripping pitches; and fixed-predetermined-length link means operatively directly connecting the tool beam to the rear of the tractor comprising a pair of draft links between the lower pivots of the respective mounting towers and beam brackets.

2. The invention of claim 1 characterized by:

said hydraulic depth actuator means comprising a pair of pin-connected cylinders effective respectively, when immobile and when foreshortenably and extensively moving, to set the towers, brackets, links, and pitch actuators relatively at rest and in motion as true parallelogram linkages when said pitch actuators are set at the predetermined link length.

3. The invention of claim 2 further characterized by:

the mounting clevis means and the towers outboard thereof occupying the same vertical plane, transverse to the tractor and its line of ripping movement, as the plane containing the pins of the cylinders which are pin-connected to the mounting clevis means, said towers having horizontal access holes aligned in said plane with pins of the cylinders thereadjacent for installation and removal of same.

4. The invention of claim 2 further characterized by:

the lower pivots of the beam brackets defining a pivot-pin opening of a predetermined hole-size relative to pins of the cylinders which are pin-connected thereby to the clevis means of the horizontal tool beam, the just said cylinder pins being smaller than said hole-size for installation and removal of each along said mutual coaxis through a pivot-pin opening.

5. The invention of claim 1 characterized by:

the clevis means having the hydraulic depth actuator means therebetween consisting respectively of a single mounting clevis and a single beam-shank-holder clevis;

said hydraulic depth actuator means therebetween consisting of a single pin-connected cylinder effective respectively, when immobile and when foreshortenably and extensibly moving, to set the towers, brackets, links, and pitch actuators relatively at rest and in motion as true parallelogram linkages when said pitch actuators are set at the predetermined link length.

* * * * *